US012515090B2

(12) United States Patent
Sorin

(10) Patent No.: US 12,515,090 B2
(45) **Date of Patent: *Jan. 6, 2026**

(54) ADJUSTABLE SUPPORT ATTACHMENT APPARATUS AND METHODS OF USING SAME

(71) Applicant: Albert Sorin, Lexington, SC (US)

(72) Inventor: Albert Sorin, Lexington, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/206,826

(22) Filed: Jun. 7, 2023

(65) Prior Publication Data

US 2023/0310920 A1 Oct. 5, 2023

Related U.S. Application Data

(62) Division of application No. 17/245,189, filed on Apr. 30, 2021, now Pat. No. 11,712,596.

(60) Provisional application No. 63/018,572, filed on May 1, 2020.

(51) Int. Cl.
*A63B 21/078* (2006.01)

(52) U.S. Cl.
CPC ..... *A63B 21/078* (2013.01); *A63B 2225/09* (2013.01)

(58) Field of Classification Search
CPC ..... A63B 21/0616; A63B 17/00; A63B 21/06; A63B 21/0615; A63B 21/0626; A63B 21/0628; A63B 21/078; A63B 21/08; A63B 21/16; A63B 21/4035; A63B 23/035; A63B 23/03508; A63B 21/055; A63B 21/0552; A63B 21/065; A63B 21/0724; A63B 21/0783; A63B 23/03541; A63B 23/03558; A63B 23/04; A63B 2023/0411; A63B 2225/093
See application file for complete search history.

(56) References Cited

U.S. PATENT DOCUMENTS

| | | | | |
|---|---|---|---|---|
| 4,856,773 A * | 8/1989 | Deola | A63B 21/0626 482/102 |
| 5,141,480 A | 8/1992 | Lennox | |
| 5,277,684 A | 1/1994 | Harris | |
| 5,554,083 A * | 9/1996 | Chen | A63B 23/1254 482/138 |
| 5,688,216 A | 11/1997 | Mauriello | |
| 5,954,619 A * | 9/1999 | Petrone | A63B 71/0036 482/106 |
| 6,482,139 B1 | 11/2002 | Haag | |
| 7,575,538 B1 | 8/2009 | Clark | |
| 7,753,830 B1 | 7/2010 | Marsh | |

(Continued)

FOREIGN PATENT DOCUMENTS

WO 2019199352 A1 10/2019

*Primary Examiner* — Andrew M Kobylarz
(74) *Attorney, Agent, or Firm* — Todd A. Serbin; Maynard Nexsen PC

(57) ABSTRACT

A support attachment apparatus for attachment to a weight rack, comprising: a main body, including an attachment portion comprising a pin hole defining a rotational axis and at least one adjustment aperture configured for insertion of a pin therein; and, a support portion comprising a support pad, wherein the support pad is configured for rotation about the rotational axis and the at least one adjustment aperture is used for adjusting an angle of the support pad with respect to the weight rack by insertion or removal of the pin therein.

12 Claims, 6 Drawing Sheets

(56) References Cited

U.S. PATENT DOCUMENTS

| | | | | |
|---|---|---|---|---|
| 7,922,630 | B1 * | 4/2011 | Batca | A63B 23/12 482/142 |
| 10,016,646 | B2 * | 7/2018 | Butler | A63B 21/062 |
| D898,137 | S | 10/2020 | Carmichael | |
| 10,850,153 | B1 * | 12/2020 | Sorin | A63B 21/0783 |
| D931,389 | S | 9/2021 | Dunahay | |
| 11,173,337 | B2 | 11/2021 | Jones | |
| 11,260,261 | B2 | 3/2022 | Henniger | |
| D948,641 | S | 4/2022 | Henniger | |
| 11,369,833 | B2 * | 6/2022 | Leipheimer | A63B 21/4043 |
| 2004/0195478 | A1 * | 10/2004 | Baldasari | A63B 71/02 248/227.3 |
| 2007/0037674 | A1 * | 2/2007 | Finn | A63B 21/0628 482/99 |
| 2007/0049472 | A1 * | 3/2007 | Hummer, Jr. | A63B 71/0036 482/104 |
| 2012/0289384 | A1 * | 11/2012 | Staten | A63B 21/0783 482/104 |
| 2014/0080685 | A1 | 3/2014 | Butler | |
| 2015/0083681 | A1 | 3/2015 | Childs | |
| 2015/0352395 | A1 * | 12/2015 | Gregory | A63B 23/1218 482/123 |
| 2015/0367168 | A1 | 12/2015 | Henniger | |
| 2019/0275363 | A1 * | 9/2019 | Jones | A63B 21/16 |
| 2020/0114195 | A1 * | 4/2020 | Henniger | A63B 21/154 |
| 2022/0072361 | A1 * | 3/2022 | Henniger | A63B 21/154 |

* cited by examiner

ADJUSTABLE SUPPORT ATTACHMENT APPARATUS AND METHODS OF USING SAME

RELATED APPLICATIONS

This application is a divisional and claims the benefit of priority under 35 U.S.C. § 120 of U.S. patent application Ser. No. 17/245,189 filed on Apr. 30, 2021, now issued as U.S. Pat. No. 11,712,596, which claims the benefit of priority under 35 U.S.C. § 119(e) of U.S. Provisional Patent Application No. 63/018,572 filed May 1, 2020, the contents of which are incorporated herein by reference in their entirety.

FIELD OF THE INVENTION

The present invention, in some embodiments thereof, relates to the fitness industry and, more particularly, but not exclusively, to a weight rack attachment.

SUMMARY OF THE INVENTION

According to an aspect of some embodiments of the present invention there is provided a support attachment apparatus for attachment to a weight rack, comprising: a main body, including an attachment portion comprising a pin hole defining a rotational axis and at least one adjustment aperture configured for insertion of a pin therein; and, a support portion comprising a support pad, wherein the support pad is configured for rotation about the rotational axis and the at least one adjustment aperture is used for adjusting an angle of the support pad with respect to the weight rack by insertion or removal of the pin therein.

In an embodiment of the invention, the at least one adjustment aperture is located above or below the pin hole on the attachment portion.

In an embodiment of the invention, the main body is divided at a rear of the attachment portion.

In an embodiment of the invention, the adjustment aperture comprises a plurality of partially overlapping pin positions in a semi-circular arrangement.

In an embodiment of the invention, the support pad is rectangular.

In an embodiment of the invention, the support pad is of unitary construction.

In an embodiment of the invention, a portion of the main body is at least partially angled with respect to another portion of the main body.

In an embodiment of the invention, the main body is straight.

In an embodiment of the invention, the attachment portion is provided with at least one protective cover.

In an embodiment of the invention, the main body includes two split sides sized a distance apart to accommodate the weight rack therebetween.

In an embodiment of the invention, the distance is greater than 3 inches (7.62 cm).

In an embodiment of the invention, the distance is greater than 4 inches (10.16 cm).

According to an aspect of some embodiments of the present invention there is provided a method of using of a support attachment apparatus with a weight rack, comprising: inserting a first pin into and through a pin hole of an attachment portion and a support portion of the apparatus thereby defining a rotational axis; rotating the support portion to a desired orientation about the rotational axis; inserting a second pin through at least one adjustment aperture to reversibly secure the support portion in a desired orientation with respect to the weight rack.

In an embodiment of the invention, the method further comprises: removing the second pin; and, rotating the support attachment to a desired second orientation.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWING(S)

Some embodiments of the invention are herein described, by way of example only, with reference to the accompanying drawings. With specific reference now to the drawings in detail, it is stressed that the particulars shown are by way of example, are not necessarily to scale and are for purposes of illustrative discussion of embodiments of the invention. In this regard, the description taken with the drawings makes apparent to those skilled in the art how embodiments of the invention may be practiced.

DESCRIPTION OF SPECIFIC EMBODIMENTS OF THE INVENTION

Figure 1:
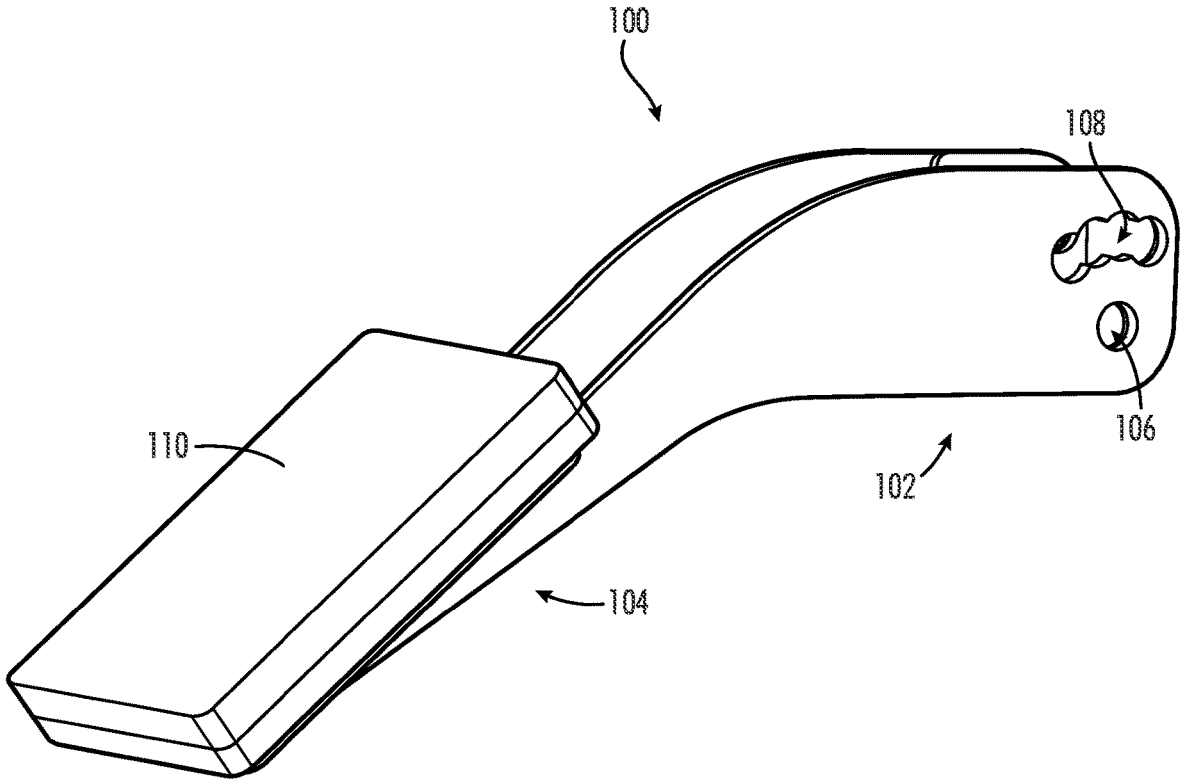
FIG. 1 is a perspective view of an adjustable support attachment, in accordance with an exemplary embodiment of the invention.

The present invention, in some embodiments thereof, relates to the fitness industry and, more particularly, but not exclusively, to a weight rack attachment.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

For the purposes of this application, "front" means the side of the adjustable support apparatus which is closest to a user facing a weight rack on which the adjustable support apparatus is mounted. "Back" or "rear" is the side of the adjustable support apparatus opposite the front. The "left" side refers to the user's left from the perspective of the user facing the weight rack and "right" is the side opposite the left. "Up" or "top" and "down" and "bottom" are also with respect to the perspective of the user facing the weight rack.

Referring now to the drawings, FIG. 1 is a perspective view of an adjustable support 100, in accordance with an exemplary embodiment of the invention. Generally, what is described herein is a support attachment which is designed to adjustably attach to a weight rack and support some or all of the weight of a user while the user is performing exercise with, in and/or in close proximity to the weight rack. It is conceived that the support attachment is adjustable in orientation with respect to the weight rack to provide expanded utility and/or customizability to a user of the support attachment, as is described hereinbelow. By taking advantage of the adjustable nature of the support attachment, a user can perform a wide variety of exercises and/or even just sit, using the support attachment as a seat for exercise or rest.

Figure 5:
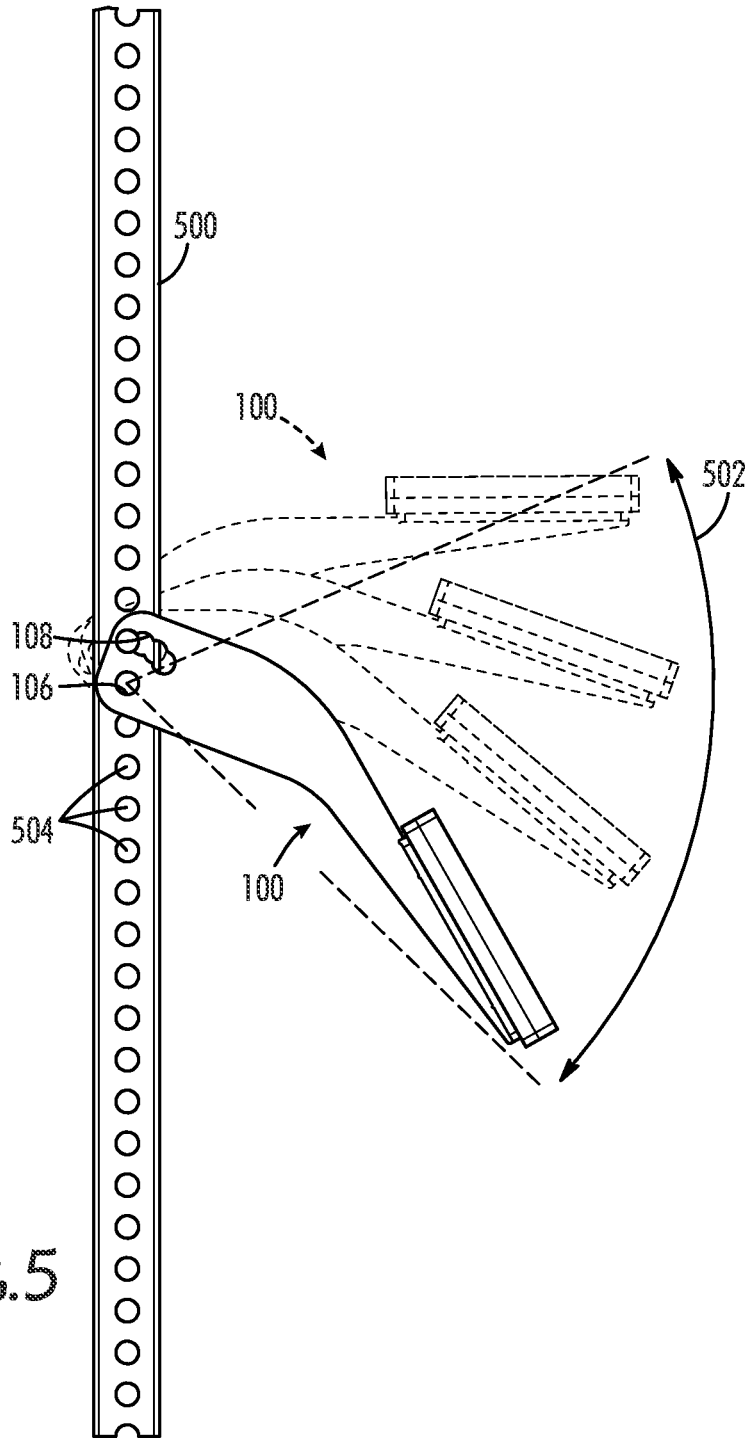
FIG. 5 is a side view of an adjustable support attachment adjusting on a weight rack, in accordance with an exemplary embodiment of the invention.
Figure 6:
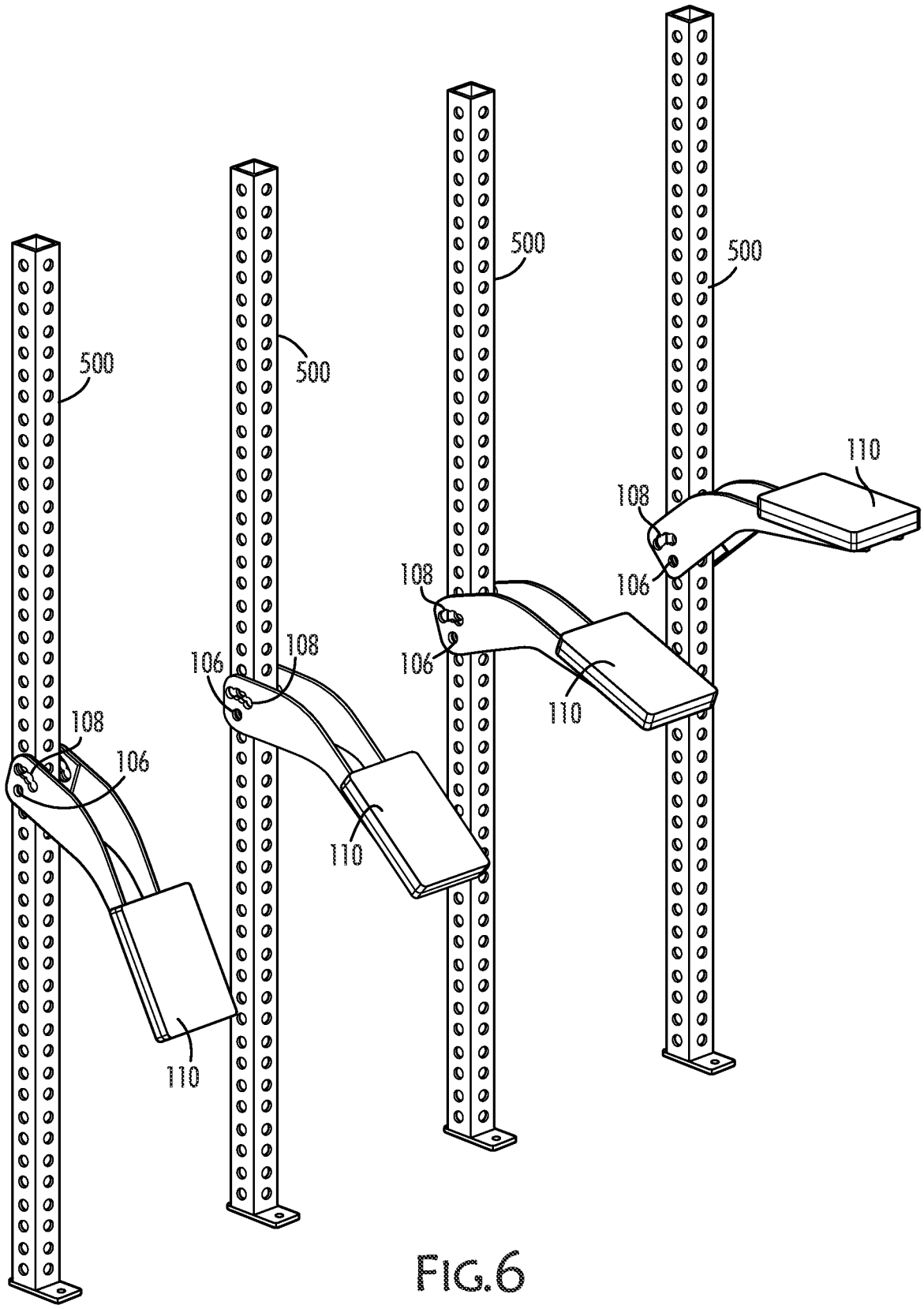
FIG. 6 is a perspective view of different exemplary positions of an adjustable support attachment, in accordance with an exemplary embodiment of the invention; and, FIG. 7 is a flowchart of a method of using of an adjustable support attachment, in accordance with an exemplary embodiment of the invention.

In an embodiment of the invention, the support attachment 100 has a main body which has an attachment portion 102 located towards the back of the support attachment 100 (on the same side as the weight rack 500, described and shown in more detail with respect to FIGS. 5 and 6) and a support portion 104 located towards the front of the support attachment 100 (closest to the user as the user faces the weight rack 500 to which the support attachment 100 is attached). In an embodiment of the invention, the main body exhibits an angular or biased shape such as shown in FIG. 1. Optionally, the main body is substantially straight.

Disposed in the attachment portion 102 is at least one pin hole 106, through which a connection pin (not shown) is inserted in order to: a) reversibly secure the support attachment 100 to the weight rack 500, by also being inserted through an attachment hole located on the weight rack; and b) to provide a pivot point for adjustment of the support attachment 100. Also disposed in the attachment portion, either above or below the pin hole 106 is at least one adjustment aperture 108 which is configured with a plurality of consecutive pin positions 202 (shown in more detail in FIG. 2), through which a second connection pin (not shown) can be inserted to provide the adjustment of the position of the support attachment 100 with respect to the weight rack on which it is attached. In some embodiments of the invention, the main body is of a generally split design, wherein there are two separated or split sides of the main body, the intention being that the distance between the split sides is intended to accommodate the tubing of a weight rack therebetween (such as shown and described in more detail with respect to FIGS. 4 and 6, inter alia). However, it should be understood that in some embodiments, only the back or attachment portion 102 of the support attachment 100 is split.

Disposed on the support portion 104 is a support pad 110 adapted for supporting some or all of the body and weight of the user of the support attachment 100. While the support shown in FIG. 1 is substantially rectangular, it should be understood that it could be virtually any shape. Further, it should also be understood that the size and/or shape are balanced to distribute the weight of the user across the support pad 110, while also permitting ease of movement of the user during exercise. In some embodiments of the invention, the support pad 110 is padded and/or covered with a durable material. Optionally, the support pad 110 is of unitary construction, such as being constructed of a shaped block made of a foam or spongy cellular material.

Figure 2:
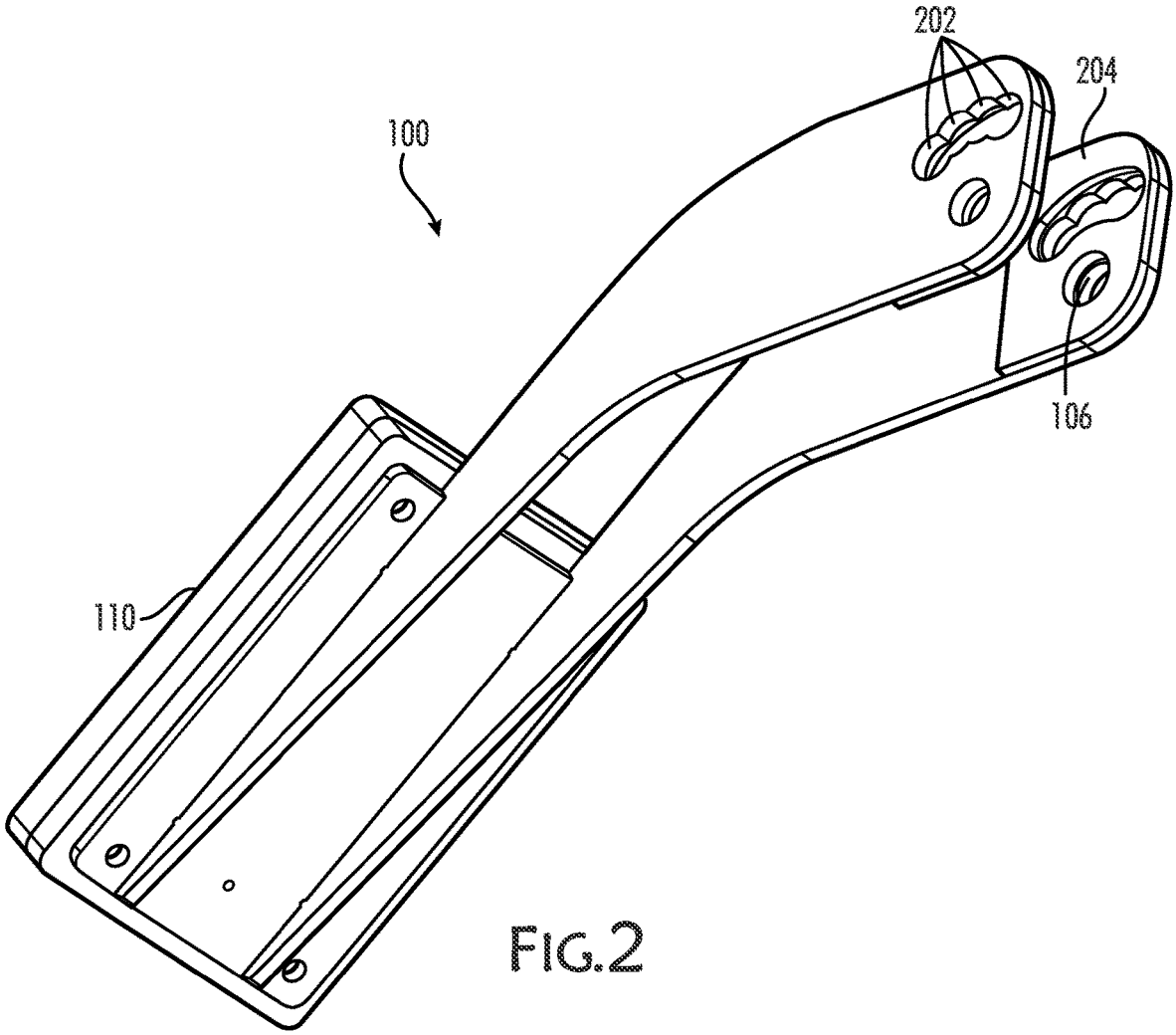
FIG. 2 is a bottom perspective view of an adjustable support attachment, in accordance with an exemplary embodiment of the invention.

FIG. 2 is a bottom perspective view of an adjustable support attachment 100, in accordance with an exemplary embodiment of the invention. As can be seen in more detail, the pin positions 202 are serially staged such that by positioning one of the pin positions in front of a corresponding attachment hole on a weight rack, the angular orientation of the support attachment 100 can be selected and/or adjusted, wherein the adjustment from one pin position to another pin position occurs by rotating the support attachment 100 around an axis created by a pin inserted into the pin hole 106. While the pin positions 202 are shown as slightly overlapping, forming a continuous adjustment aperture 108, it should be understood that in some embodiments, a plurality of discrete pin positions 202 are disposed in the attachment portion 102 configured in a semi-circular or arcing arrangement to factor in rotational movement of the support attachment 100 about the pin hole 106 axis.

In an embodiment of the invention, the main body of the support attachment 100 is divided, at least at the rear so that the main body is disposed on each side of the weight rack vertical component when the support attachment 100 is positioned on the weight rack. Optionally, only the interfacing side (or back side) of the attachment portion 102 is divided to accommodate the weight rack therein (i.e. the main body is otherwise not divided and forks near the rear of the attachment portion 102). In some embodiments of the invention, the inner surfaces of the attachment portion 102 are provided with protective covers 204 to act as a buffer between the support attachment 100 and the weight rack.

In some embodiments of the invention, a connection pin is long enough to be inserted through both sides of the divided main body, that is when a connection pin is inserted into the pin hole 106 on one side of the main body, it traverses the weight rack 500 and then passes through the pin hole 106 on the second side of the divided main body. Similarly, the second connection pin is long enough to pass from one side through the adjustment aperture through the weight rack and through the adjustment aperture on the other side of the main body. In some embodiments of the invention, shorter connections pins are inserted into each side of the main body and into the weight rack.

Figure 3:
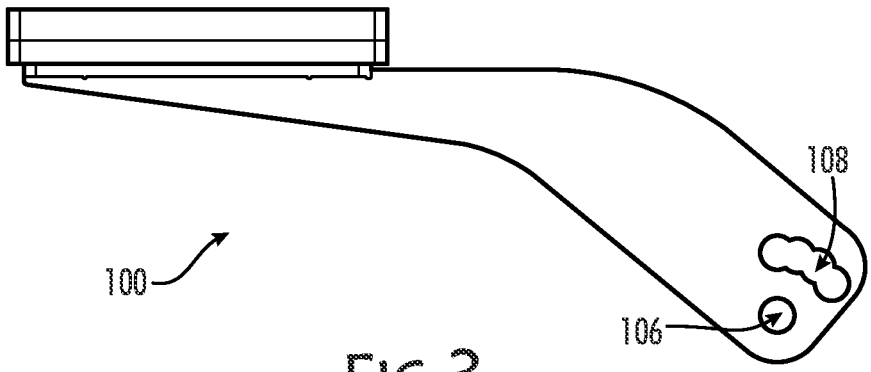
FIG. 3 is a side view of an adjustable support attachment, in accordance with an exemplary embodiment of the invention.
Figure 4:
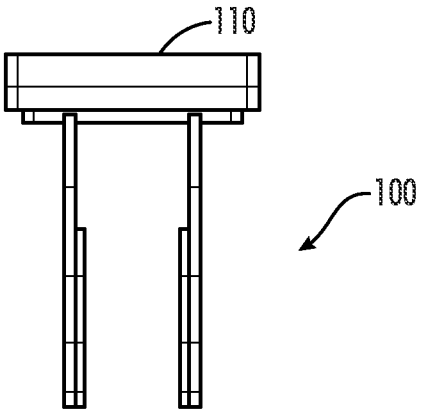
FIG. 4 is a front view of an adjustable support attachment, in accordance with an exemplary embodiment of the invention.

FIG. 3 is a side view of an adjustable support attachment 100, in accordance with an exemplary embodiment of the invention. FIG. 4 is a front view of an adjustable support attachment 100, in accordance with an exemplary embodiment of the invention. In an embodiment of the invention, the support attachment is about 26 inches long (from front to back), is about 11.2 inches tall, and is about 4.3 inches from the outside of one split side to the outside of the other split side. In some embodiments of the invention, the inside space/distance between the split main body components is sized to accommodate a standard weight rack 500 tube component therein, which are typically 3 inches×3 inches (7.62 cm×7.62 cm) or 4 inches×4 inches (10.16 cm×10.16 cm). Therefore, the distance between the split main body components is slightly larger than 3 inches or slightly larger than 4 inches apart. It should be noted that dimensions are by way of example only, and that the support attachment 100 could be of virtually any physical dimension in height, length, width, etc.

FIG. 5 is a side view of an adjustable support attachment 100 adjusting position with respect to the weight rack 500, in accordance with an exemplary embodiment of the invention. FIG. 5 shows that the pin hole 106 and each pin position 202 of the adjustment aperture 108 aligns with a corresponding attachment hole 504 on the weight rack 500. In operation, the support attachment 100 is rotated 502 about the pin hole 106 axis to adjust the orientation of the support attachment 100 with respect to the weight rack.

FIG. 6 is a perspective view of different exemplary positions of an adjustable support attachment 100 with respect to the weight rack 500 which generally correspond to those shown in FIG. 5, in accordance with an exemplary embodiment of the invention. Not shown in FIG. 6 are the connecting pins/screws/bolts (e.g. hitch pins), which are inserted into the pin holes 106, pin positions 202 and/or the attachment holes 504, but which would be used as described below to removably secure and/or adjust the support attachment 100 with respect to the weight rack 500.

Figure 7:
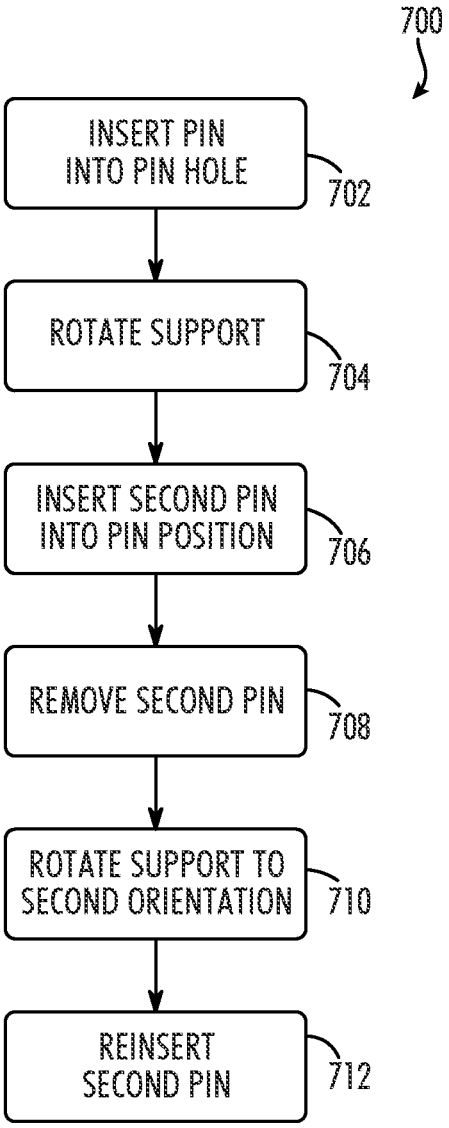

FIG. 7 is a flowchart 700 of a method of using of an adjustable support attachment 100, in accordance with an exemplary embodiment of the invention. In an embodiment of the invention, the support attachment 100 is removably attached to the weight rack 500 by inserting (702) a connecting pin into and through the pin hole 106 and into and through a corresponding attachment hole 504 on the weight rack 500. The support attachment 100 is then rotated (704) to a desired orientation by the user such that the pin position 202 of the adjustment aperture 108 corresponding to the desired orientation is aligned with a second corresponding attachment hole 504 on the weight rack 500, both of which a second connection pin is inserted (706) to reversibly secure the support attachment 100 in a desired orientation with respect to the weight rack 500. The method further comprises adjusting the orientation of the support attachment 100 to a second desired orientation by removing (708) the second connection pin, rotating (710) the support attachment to the second desired orientation, and then reinserting (712) the second connection pin in the second corresponding attachment 504 hole to secure the support attachment 100 into the second desired orientation. It should be understood that at each desired orientation, the user may be performing one or more exercises on, with and/or near the weight rack 500, or may even just place it in a horizontal orientation as a seat (for exercise or for rest).

It is expected that during the life of a patent maturing from this application many relevant weight rack supports will be developed and the scope of the term support is intended to include all such new technologies a priori.

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

The term "plurality" means "two or more".

As used herein, the singular form "a", "an" and "the" include plural references unless the context clearly dictates otherwise. For example, the term "a compound" or "at least one compound" may include a plurality of compounds, including mixtures thereof.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A support attachment apparatus for attachment to a weight rack, comprising:

a main body, including an attachment portion comprising a pin hole defining a rotational axis and at least one adjustment aperture configured for insertion of a pin therein, wherein the at least one adjustment aperture is located above or below the pin hole on the attachment portion; and, a support portion comprising a support pad, wherein the support pad is configured for rotation about the rotational axis and the at least one adjustment aperture is used for adjusting an angle of the support pad with respect to the weight rack by insertion or removal of the pin therein, and, wherein the main body includes two split sides sized a distance apart to accommodate the weight rack therebetween.

2. The support attachment apparatus according to claim 1, wherein the main body is split at a rear of the attachment portion.

3. The support attachment apparatus according to claim 1, wherein the at least one adjustment aperture comprises a plurality of partially overlapping pin positions in a semi-circular or arcing arrangement.

4. The support attachment apparatus according to claim 1, wherein the support pad is rectangular.

5. The support attachment apparatus according to claim 1, wherein the support pad is of unitary construction.

6. The support attachment apparatus according to claim 1, wherein a portion of the main body is at least partially angled with respect to another portion of the main body.

7. The support attachment apparatus according to claim 1, wherein the main body is straight.

8. The support attachment apparatus according to claim 1, wherein the attachment portion is provided with at least one protective cover on a side facing the weight rack.

9. The support attachment apparatus according to claim 1, wherein the distance is greater than 3 inches (7.62 cm).

10. The support attachment apparatus according to claim 1, wherein the distance is greater than 4 inches (10.16 cm).

11. A method of using of a support attachment apparatus with a weight rack, comprising:

inserting a first pin into and through a pin hole of an attachment portion and a support portion of a main body of the apparatus thereby defining a rotational axis, wherein the main body includes two split sides sized a distance apart to accommodate the weight rack therebetween;

rotating the support portion to a desired orientation about the rotational axis;

inserting a second pin through at least one adjustment aperture, wherein the at least one adjustment aperture is located above or below the pin hole on the attachment portion, to reversibly secure the support portion in a desired orientation with respect to the weight rack.

12. The method of using of the support attachment with the weight rack according to claim 11, further comprising:

removing the second pin;

rotating the support attachment to a desired second orientation.

* * * * *